US006209160B1

(12) United States Patent
Harris

(10) Patent No.: US 6,209,160 B1
(45) Date of Patent: Apr. 3, 2001

(54) INFLATION ASSEMBLIES

(75) Inventor: John Harris, Newport (GB)

(73) Assignee: Frontier Plastics Limited, Blackwood (GB)

( * ) Notice: Subject to any disclaimer, the term of this patent is extended or adjusted under 35 U.S.C. 154(b) by 0 days.

(21) Appl. No.: 09/180,633

(22) PCT Filed: Mar. 23, 1998

(86) PCT No.: PCT/GB98/00880

§ 371 Date: Nov. 10, 1998

§ 102(e) Date: Nov. 10, 1998

(87) PCT Pub. No.: WO98/42238

PCT Pub. Date: Oct. 1, 1998

(30) Foreign Application Priority Data

Mar. 24, 1997 (GB) ..... 9706045
May 17, 1997 (GB) ..... 9709957

(51) Int. Cl.[7] ..... A47C 27/08
(52) U.S. Cl. ..... 5/708; 5/706; 5/655.3
(58) Field of Search ..... 5/706, 708, 654, 5/655.3; 417/437, 451, 460, 463, 467, 269

(56) References Cited

U.S. PATENT DOCUMENTS 2,573,375 * 10/1951 Winstead ..... 5/708 X
2,686,006 * 8/1954 Hasselquist ..... 5/708 X
4,521,166 6/1985 Phillips .
4,862,533 9/1989 Adams, III .
4,977,633 12/1990 Chaffee .
5,318,568 6/1994 Kaufmann et al. .
5,406,661 4/1995 Pekar .
5,507,626 * 4/1996 Yang ..... 417/467 X
5,518,376 5/1996 Haroaka .

FOREIGN PATENT DOCUMENTS

3137921A1 4/1983 (DE) .

* cited by examiner

*Primary Examiner*—Terry Lee Melius
*Assistant Examiner*—Frederick Conley
(74) *Attorney, Agent, or Firm*—King and Schickli, PLLC

(57) ABSTRACT

A pump is formed by a pair of sleeves 1,2 each of which is closed at one end. The end of sleeve 2 incorporates an inlet valve in the form of a membrane 11 which lifts to allow air to enter the pump through an opening 22 as the pump sleeves 1,2 are extended. When the sleeves 1,2 are closed against one another, the membrane 11 closes and a second membrane 12 lifts to allow air to pass through opening 15 communicating with a connection 16 for attachment to the inflation inlet 5 of an inflatable mattress 3. A pressure relief valve 17 prevents the mattress 3 from being over-inflated. The deflated mattress 3 can be stored in the space within the two sleeves 1,2.

7 Claims, 4 Drawing Sheets

INFLATION ASSEMBLIES

Inflated mattresses (and similar support members for supporting limb portions of a body) are often provided in hospitals. A particular situation where an inflatable mattress is of value is for the easing of bed sores. Such mattresses generally require a bulky pump (possible powered from the electrical mains) and there may be associated control equipment to adjust the pressure within the whole or a part of the mattress due to changing circumstances. Such overall assemblies necessarily are not readily transportable and this limits the potential use of such assemblies in the home when a patient is discharged from hospital but may still benefit from the use of an inflated mattress or the like.

According to the present invention there is provided an inflation assembly comprising an inflatable support member for supporting the body or a limb portion of a person, the support member having an inflation inlet provided with a one way inlet valve, together with a container for housing the support member in its deflated state, the container comprising two sleeves each open at one end and closed at the other end and nesting within one another to define a pump having a one way inflation valve in one end adopted for connection to said inflation inlet, the inflation valve also incorporating a pressure limiting relief member for ensuring that the support member cannot be inflated by the pump to greater than a predetermined pressure.

Such an assembly is readily transportable when the support member is in its deflated state and rolled up and stored within the housing. It will then occupy a relatively small space and will be lightweight (it is envisaged that the housing will be constructed from robust but lightweight cardboard material). The housing is ideally of cylindrical form and of circular cross-section but it would be possible, for example, to make the housing with a square cross-section or some other desired shape.

Ideally the pressure relief valve incorporates an outlet passageway from the pump with a valve body within said outlet passageway and releasably biased towards the interior of the pump into a closing position on a valve seat. The one way inflation valve can advantageously incorporate first and second flexible membranes which act respectively to close off a first opening from the exterior to the interior of the pump and a second opening from the pump interior to the inflation valve outlet, depending upon whether there are positive or negative pressure conditions respectively within the pump. In this arrangement it is preferred that said first flexible membrane carries peripheral ears which will be pressed down by the inner sleeve when the two sleeves are moved fully together to deflect that membrane off the first opening to enable excess pressure within the pump to be relieved.

In the preferred arrangement the connection of the inflation valve to the inflation inlet is effective to open the inlet valve. It may be desirable to provide a separate connection member for linking the inflation valve to the inflation inlet.

It is particularly advantageous to provide a releasable carrying cord which is connected between the two ends of the container, the length of the cord being such as to limit the degree of allowable extension of the pump to a desired extent. The cord then ensures that the two parts of the housing cannot become detached whilst the housing is being used as a pump, which could cause damage to the housing. The cord also provides a very convenient carrying member which additionally acts to hold the two parts of the housing together during transportation.

A pressure relief cap can be provided for insertion into the inlet valve to open the inlet valve to allow deflation of the support member. After deflation the support member can be rolled up and stored away again within the housing.

The invention may be performed in various ways and a preferred embodiment will now be described, by way of example, with reference to the accompanying drawings, in which.

Figure 1:
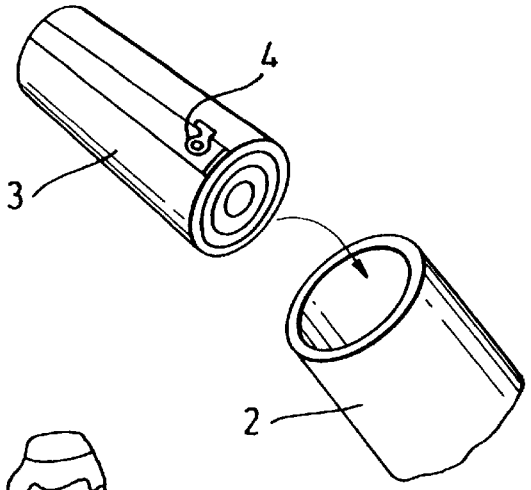
FIG. 1 is a perspective view of parts of a inflation assembly of the invention.
Figure 2:
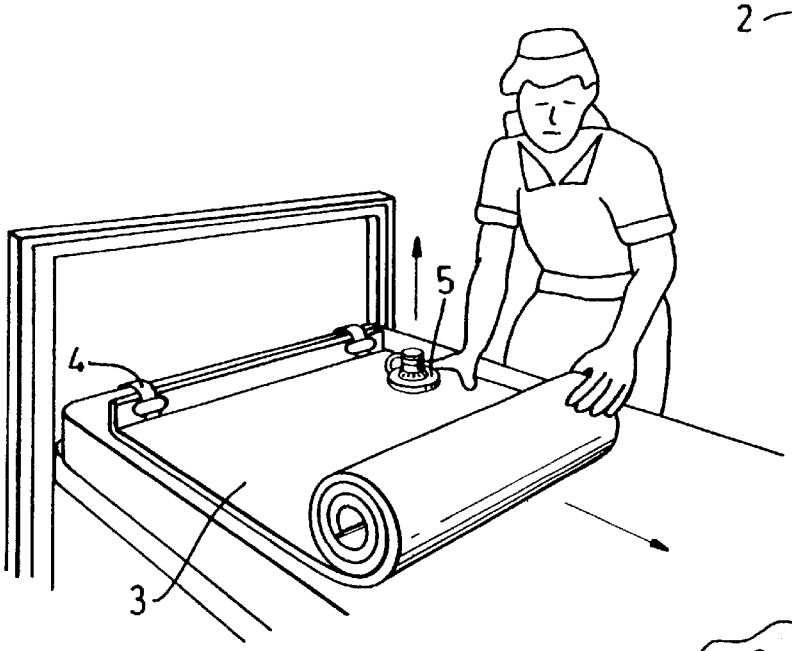
FIG. 2 illustrates an inflatable support member and of the assembly of FIG. 1 which is being unrolled.
Figure 3:
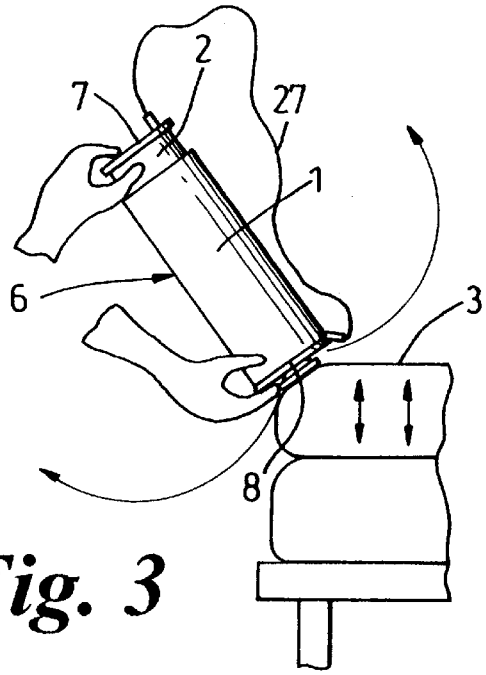
FIG. 3 shows how the support member can be inflated by a pump.

The assembly illustrated in the drawings comprises a pair of cylindrical sleeves 1 and 2 (FIG. 3) within which can be housed a deflated and rolled up inflation mattress 3 (FIG. 1). When the mattress is removed from the sleeve 2 it can be laid on a bed, held in position by locating straps 4 and unrolled into a flat state. The mattress incorporates an inlet valve 5 to which the pump 6 shown in FIG. 3 can be connected.

Figure 4:
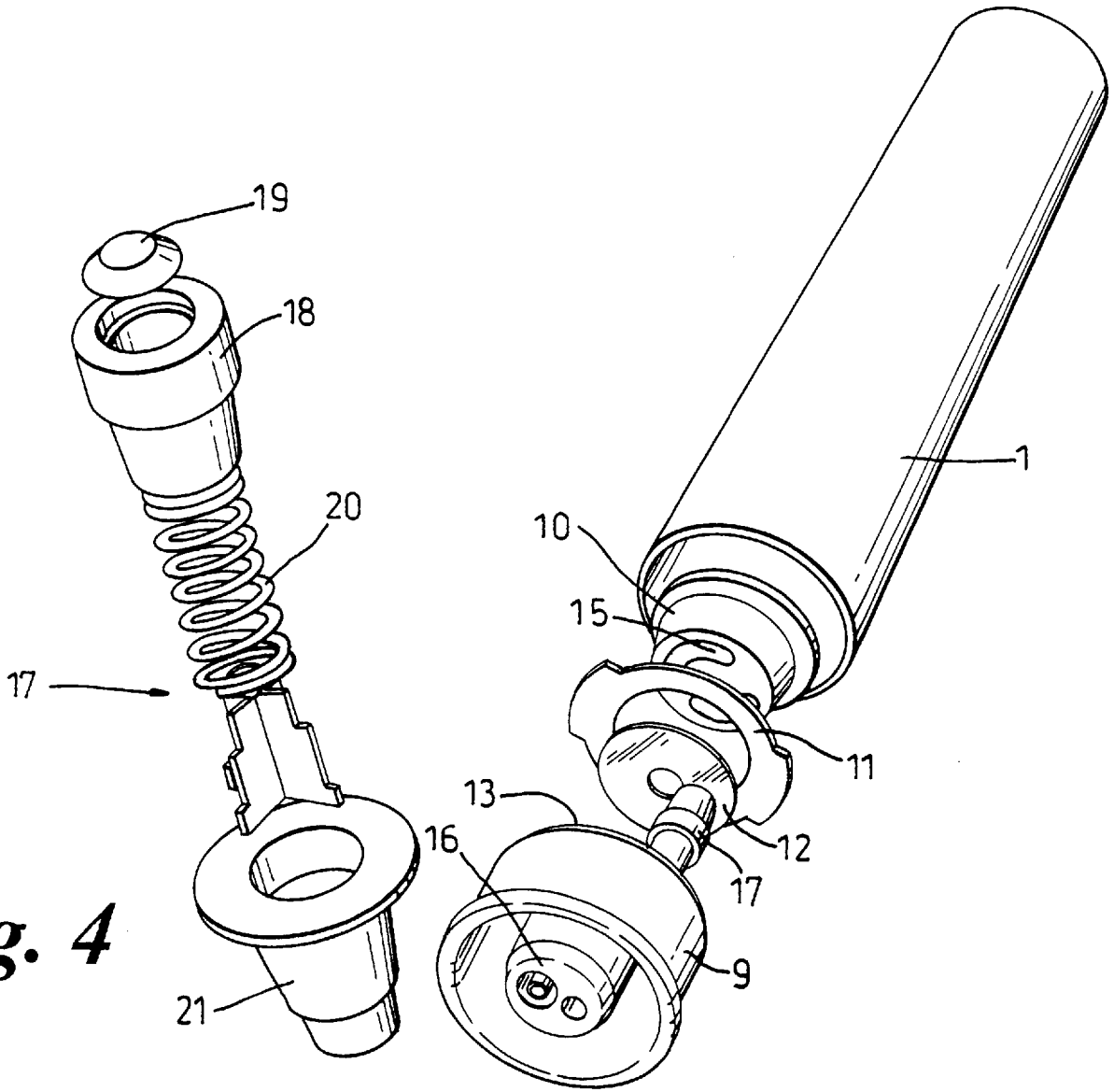
FIG. 4 is an exploded view illustrating various parts of the pump valves.
Figure 5:
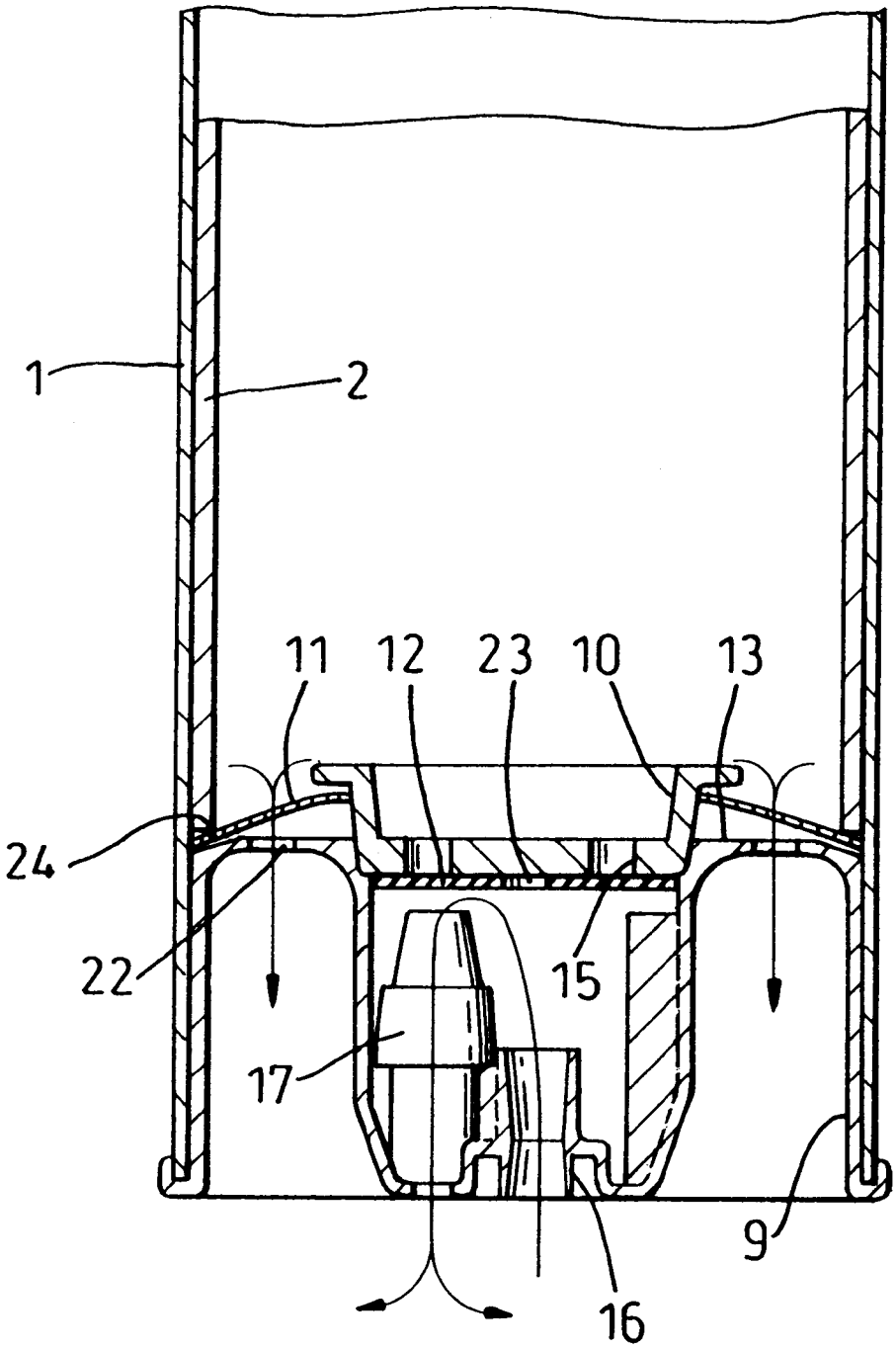
FIG. 5 is a cross section through the operating end of the inflation pump of FIG. 4.
Figure 6:
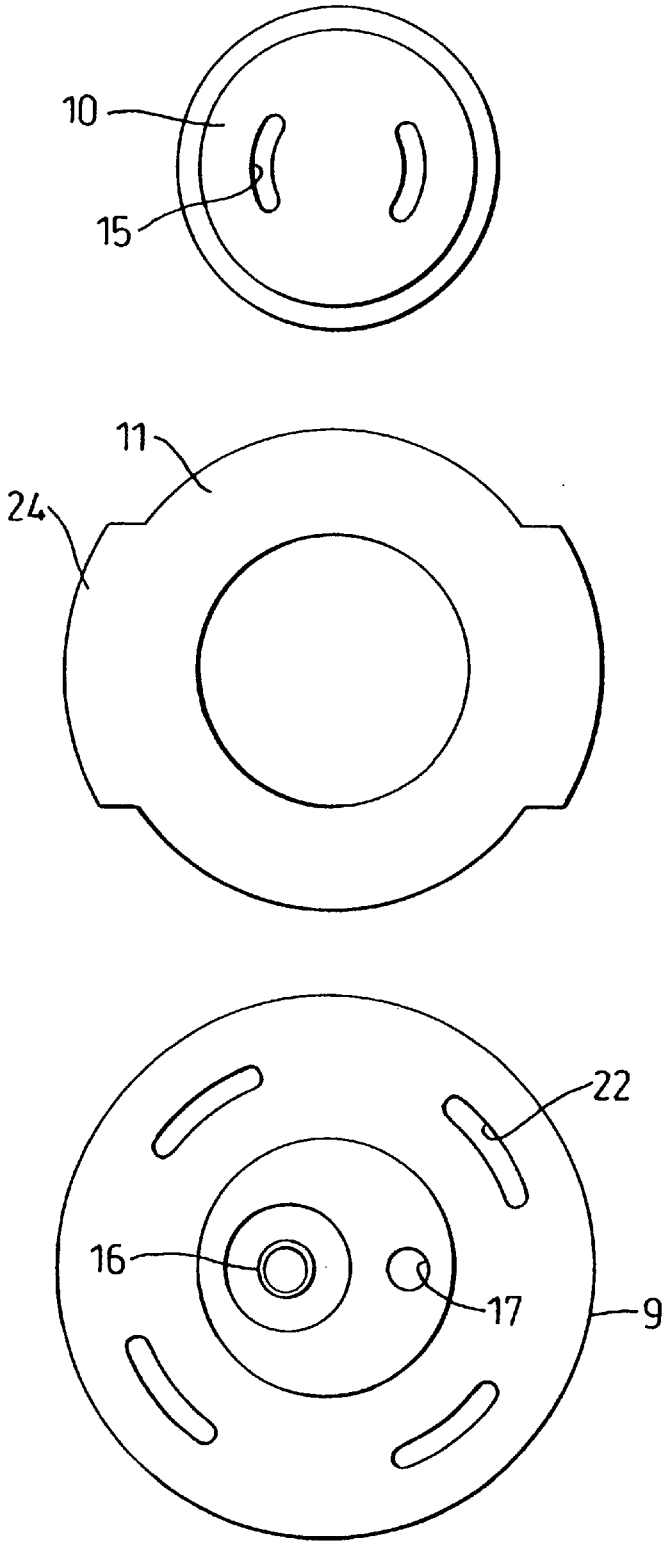
FIG. 6 is an exploded view of the end cap, retention cap and a membrane forming part of the assembly shown in FIG. 4.

The pump comprises the sleeves 1 and 2. The sleeve 2 is closed at the one end 7. The closed end 8 of the sleeve 1 incorporates an inflation valve assembly as illustrated in detail in FIGS. 4, 5 and 6. An end cap 9 is mounted into the closed end of the sleeve 1. A retention cap 10 holds in place two membranes 11 and 12. The membrane 11 sits over inlet holes in the lower face 13 of the cap 9. The inner membrane 12 locates over outlet holes 15 in the retention cap 10. The end cap 9 has a central projection 16 which can be connected to the inlet valve 5 of the inflatable mattress 3, either directly or via a separate connection member.

When the pump is operated, by reciprocating the sleeves 1 and 2 with respect to one another, air is drawn into the expanding space within the two sleeves, as the pump is extended, by entering through the holes 22 (FIGS. 5 and 6) in the base 13 of the end cap 9 as the membrane 11 lifts away. When the sleeves 1 and 2 are pushed together the membrane 11 is pressed down by air pressure to close off the openings 22 in the base 13 of the end cap 9, but air is able to pass through the holes 15 in the retention cap 10 to push away the membrane 12 and thus allow air to pass through the projection 16 and the attached inflation valve 5 of the mattress.

When a desired inflation pressure is reached a pressure limiting relief member 17 operates to prevent further inflation of the mattress. This relief member 17 is shown in detail in enlarged view in FIG. 4. The relief member has a valve body 18 pressed against a valve seal 19 by a spring 20. However when the air pressure within the pump 6 reaches a predetermined level the valve body 18 is able to move away from the valve seal 19 by compressing the spring 20 so that the excess pressure is relieved through an outlet passageway 21.

In order for the air to escape through the relief member 17, the assembly has been designed so that the membrane 12 can lift off the inlet to the member 17. Although the membrane 12 has a small central hole 23 (FIG. 5) formed in it, the pressure either side of the membrane 12 may be equalised (between that in the centre of the end cap 9 and within the inner sleeve 2) so that there will be no tendency for the membrane 12 to lift. To avoid this the membrane 11 is formed with ears 24. As can be seen from FIG. 5 these ears will be pressed down when the sleeve 2 is pushed fully into the sleeve 1 (which will tend to be the final condition when the pump is operated). The ears 24 then cause the membrane 11 to lift so that the pressurised air within the sleeve 2 can escape through the holes 22 thus enabling the membrane 12 to lift from the member 17 towards the base of the retention cap 10 so that excess pressure within the mattress can escape through the projection 16 and out through the pressure relief member 17.

Figure 7:
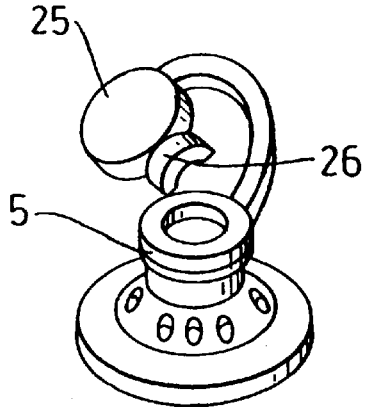
FIG. 7 shows a pressure release cap.

When it is desired to deflate the mattress for storage a pressure release cap 25 (FIG. 7) can be inserted into the inlet valve 5. The semi-circular neck 26 of the release cap 25 causes the valve 5 to open so that the air can escape. The mattress can then be rolled up after deflation and reinserted into the container provided by the sleeves 1 and 2.

A cord 27 (FIG. 3), releasable at one end, can be connected between the ends of the sleeve 1, 2 to limit the extension of the pump so that the sleeves do not become detached during the inflation process.

In the preferred design the mattress 3 will be formed from a breathable thermoplastic film in the form of a blown film extruded from thermoplastic polyester urethane elastomer which has been produced by coextrusion with a polyethylene carrier film. The elastomer film, when removed from the carrier, provides a film which has been found to allow transmission of water vapour at a rate sufficient to prevent sweating, but which is substantially impermeable to air. Thus the inflated mattress can sustain its inflated state for long periods which means that it is not normally necessary to re-inflate or top up the mattress in use. An example of a suitable material is a thermoplastic polyurethane elastomer film known as Platilon (Registered Trade Mark) U01, manufactured and marketed by Deutsche Atochem Werke in Germany.

The invention is not limited to mattresses but may comprise other inflation support members which may be used for supporting limb portions of a person. These are particularly valuable for use with patients suffering from burns.

What is claimed is:

1. An inflation assembly comprising an inflatable support member for supporting the body or a limb portion of a person and a container for housing the support member in a deflated state, said inflatable support member having an inflation inlet provided with a one way inlet valve, said container comprising an inner sleeve and an outer sleeve with said inner and outer sleeves each open at a first end and closed at a second end, and nesting within one another to define a pump having an enclosed interior and a one way inflation valve adapted for connection to said inflation inlet on said support member, wherein said one way inflation valve incorporates first and second flexible membranes which act respectively to close off a first opening from said interior to a region exterior to said pump and a second opening from said interior to an outlet of said inflation valve, depending upon whether there are positive or negative pressure conditions respectively within the pump, said inflation valve also incorporating a pressure limiting relief member for ensuring that said support member cannot be inflated by said pump to greater than a predetermined pressure.

2. An assembly according to claim 1, wherein the pressure limiting relief member incorporates an outlet passageway from the pump with a valve body within said outlet passageway and releasably biased towards said interior into a closing position on a valve seat.

3. An assembly according to claim 1, wherein said first flexible membrane carries peripheral ears which will be pressed down by the inner sleeve when the two sleeves are moved fully together to deflect said first flexible membrane off the first opening to enable excess pressure within the pump to be relieved.

4. An assembly according to claim 1, wherein the connection of the inflation valve to the inflation inlet is effective to open said inlet valve.

5. An assembly according to claim 1, wherein a separate connection member is provided for linking the inflation valve to the inflation inlet.

6. An assembly according to claim 1, wherein a pressure release cap is provided for insertion into the inlet valve to open the inlet valve to allow deflation of the support member.

7. An inflation assembly comprising an inflatable support member for supporting the body or a limb portion of a person and a container for housing the support member in its deflated state, said inflatable support member having an inflation inlet provided with a one way inlet valve, said container comprising an inner sleeve and an outer sleeve with said inner and outer sleeves each open at a first end and closed at a second end and nesting within one another to define a pump having an enclosed interior and a one way inflation valve in one end adapted for connection to said inflation inlet on said support member, wherein said one way inflation valve incorporates first and second flexible membranes which act respectively to close off a first opening from said interior to a region exterior to said pump and a second opening from said interior to an outlet of said inflation valve, depending upon whether there are positive or negative pressure conditions respectively within the pump, said inflation valve also incorporating a pressure limiting relief member for ensuring that said support member cannot be inflated by said pump to greater than a predetermined pressure, said inflation assembly further including a releasable carrying cord connected between said closed second ends of said inner and said outer sleeves of said pump, said cord being of a length such as to limit to a predetermined degree the allowable extension of said pump.

* * * * *